US008276881B2

(12) United States Patent
Chou et al.

(10) Patent No.: US 8,276,881 B2
(45) Date of Patent: Oct. 2, 2012

(54) LIFTING MECHANISM WITH SELF-LOCKING FUNCTION

(75) Inventors: Chi-Pin Chou, Taichung (TW); Chang-Cheng Ho, Taichung (TW)

(73) Assignee: Hiwin Mikrosystem Corp., Taichung (TW)

( * ) Notice: Subject to any disclaimer, the term of this patent is extended or adjusted under 35 U.S.C. 154(b) by 442 days.

(21) Appl. No.: 12/646,631

(22) Filed: Dec. 23, 2009

(65) Prior Publication Data

US 2011/0147685 A1 Jun. 23, 2011

(51) Int. Cl.

| | |
|---|---|
| ***B66F 3/24*** | (2006.01) |
| ***B66F 7/16*** | (2006.01) |
| ***B66F 3/36*** | (2006.01) |
| ***B66F 3/00*** | (2006.01) |

(52) U.S. Cl. ..... 254/93 R; 254/93 L; 254/100; 254/134; 254/126

(58) Field of Classification Search ..... 254/93 R, 254/93 L, 100, 134, 126

See application file for complete search history.

(56) References Cited

U.S. PATENT DOCUMENTS 4,092,011 A * 5/1978 Luebke ..... 254/8 C

* cited by examiner

*Primary Examiner* — Monica Carter
*Assistant Examiner* — Nirvana Deonauth
(74) *Attorney, Agent, or Firm* — Guice Patents PLLC

(57) ABSTRACT

A lifting mechanism with self-locking function, including an ascending/descending seat, a rocking member pivotally connected with the ascending/descending seat, a guide section and a prestressing section. The rocking member serves to convert a horizontal force provided by a power source into a vertical force to up and down reciprocally move the ascending/descending seat in the direction of Z-axis. The guide section includes guide members, which can be cross roller ways for guiding the ascending/descending seat to ascend/descend. The prestressing section can be adjusted to change the gaps between fixed guide rails and movable guide rails of the cross roller ways. Accordingly, the sliding friction between the fixed guide rails and the movable guide rails can be adjusted to provide auxiliary locking force for locating the ascending/descending seat.

4 Claims, 5 Drawing Sheets

LIFTING MECHANISM WITH SELF-LOCKING FUNCTION

BACKGROUND OF THE INVENTION

The present invention relates generally to a Z-axis lifting technique, and more particularly to a lifting mechanism with self-locking function.

Various lifting techniques have been developed for ascending/descending a load in the direction of Z-axis. For example, a power output shaft of a power source such as a motor or a hydraulic cylinder can be used to directly apply a force to the load and move the load in the direction of Z-axis. Alternatively, the power source can drive the load and move the load in the direction of Z-axis via a reduction mechanism such as a worm and a worm wheel. When the load is lifted to a high position, the power source can keep the load at the height by its own holding capability. Alternatively, the load can be lifted by means of wedge structures with guide slopes in slidable contact with each other. The guide slopes have a certain inclination angle and serve to convert the horizontal sliding force into the lifting force in the direction of Z-axis to save strength and reduce the speed.

The conventional lifting apparatuses are applicable to various fields. However, such lifting apparatuses are not optimal and have some defects. For example, with respect to the direct-drive technique, the power source must be continuously powered on to provide the necessary power. With respect to the transmission technique of the worm and worm wheel, it is impossible to apply such technique to a vacuumed or clean room. With respect to the wedge structures, such structures have poor self-locking capability. When the load is stopped on the guide slopes or during the lifting process of the load, the lead angle must be gradually decreased until nearly horizontal. Under such circumstance, the vertical component force is much smaller than the horizontal component force so as to achieve self-locking effect. According to such arrangement, the volume of the apparatus is increased as a whole. Moreover, it cannot be ensured that the load stably stops on the guide slopes. In some cases, the load may displace due to vibration or change of vertical loadability. Therefore, it is impossible for such conventional lifting apparatus to have secure self-locking effect in any position.

SUMMARY OF THE INVENTION

It is therefore a primary object of the present invention to provide a lifting mechanism with self-locking function. The lifting mechanism is applicable to a vacuumed operation environment such as a clean room to provide lifting effect for a load. The lifting mechanism has secure self-locking function, whereby the load can be lifted to a height and kept at the height.

It is a further object of the present invention to provide the above lifting mechanism, which includes a prestressing section. By means of the prestressing section, the sliding friction of the lifting mechanism can be adjusted in accordance with actual requirements.

To achieve the above and other objects, the lifting mechanism with self-locking function of the present invention includes: a bed; a guide section for linear reciprocal motion; an ascending/descending seat mounted on and guided by the guide section to up and down reciprocally move in the direction of Z-axis; a rocking member with a predetermined length, a first end of the rocking member being pivotally connected to the ascending/descending seat; a drive section having a power output terminal connected to a second end of the rocking member for driving the rocking member to pivotally move between an ascending position and a descending position, when positioned in the ascending position, the length of the rocking member being parallel to Z-axis, while when positioned in the descending position, the length of the rocking member and the Z-axis containing a predetermined angle; and a prestressing section for changing sliding friction of the guide section.

The present invention can be best understood through the following description and accompanying drawings, wherein:

DETAILED DESCRIPTION OF THE PREFERRED EMBODIMENT

Figure 1:
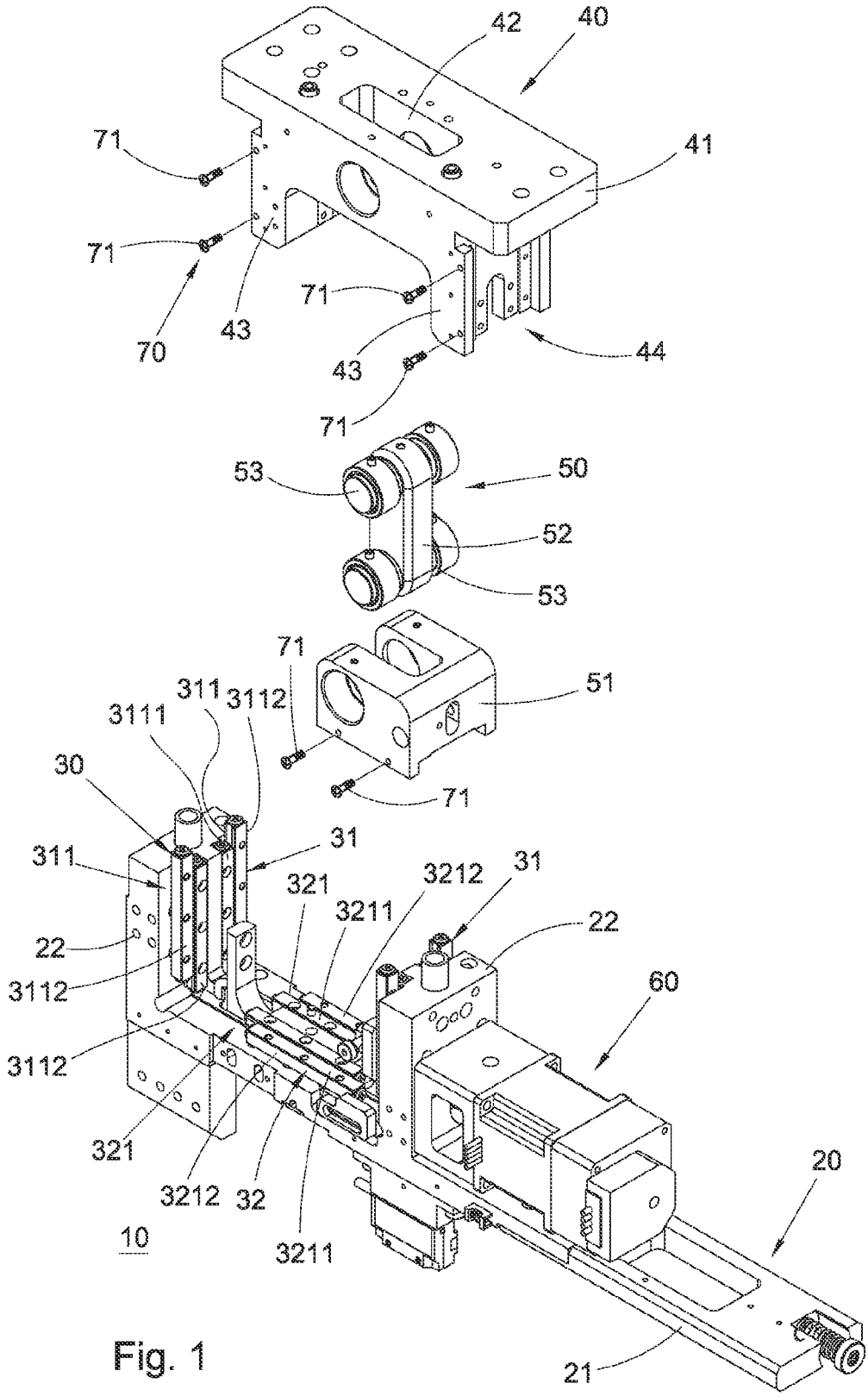
FIG. 1 is a perspective exploded view of a preferred embodiment of the present invention.
Figure 2:
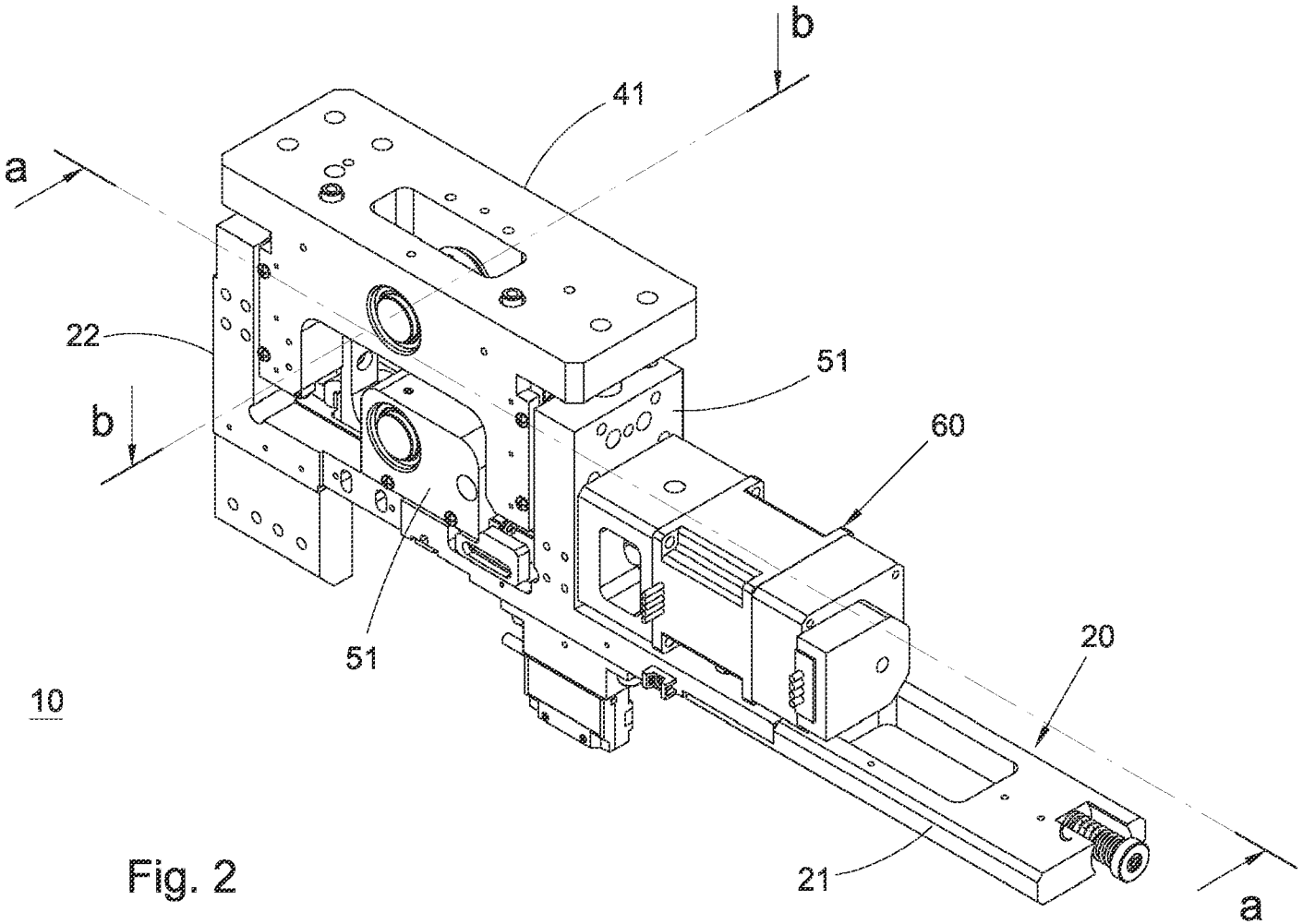
FIG. 2 is a perspective assembled view of the preferred embodiment of the present invention.
Figure 3:
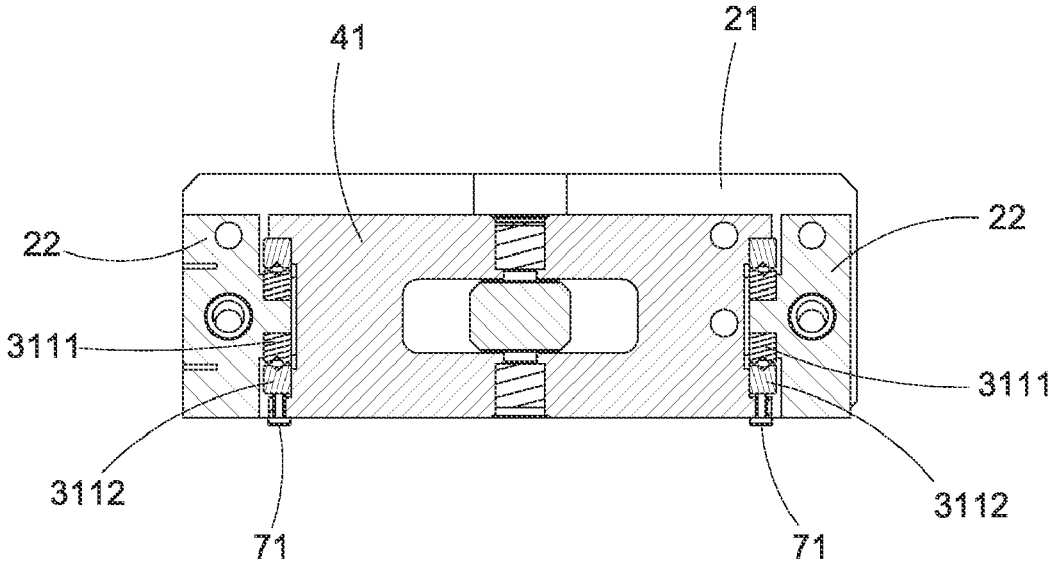
FIG. 3 is a sectional view taken along line a-a of FIG. 2.
Figure 4:
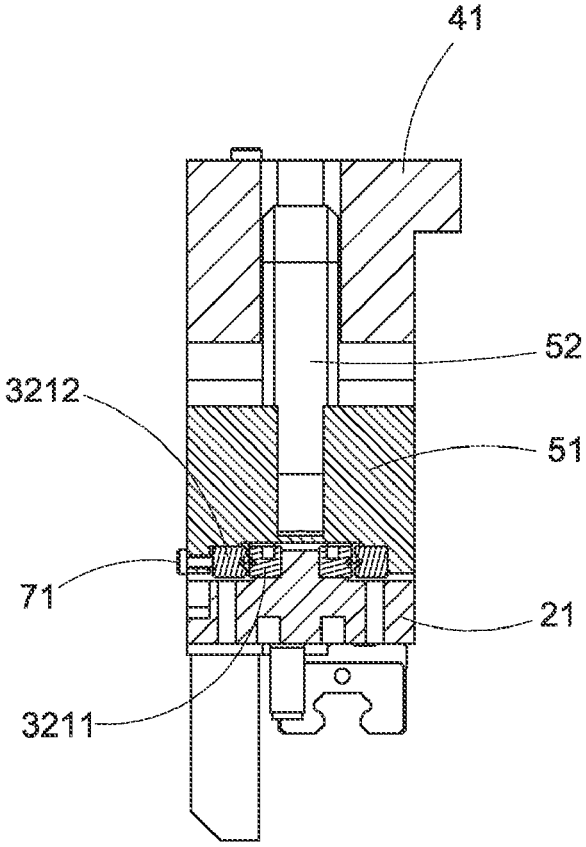
FIG. 4 is a sectional view taken along line b-b of FIG. 2.
Figure 5:
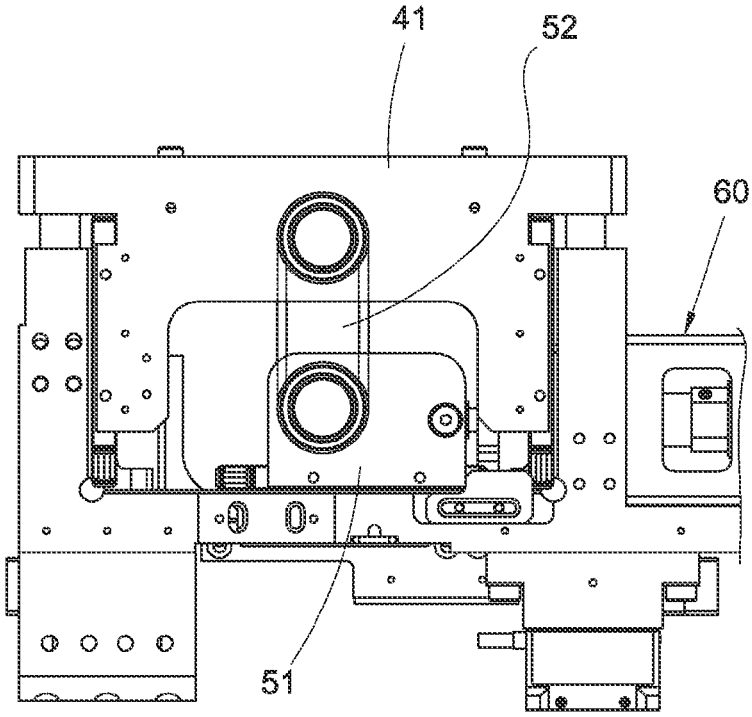
FIG. 5 is a front view of the preferred embodiment of the present invention, showing that the rocking arm is positioned in an ascending position.
Figure 6:
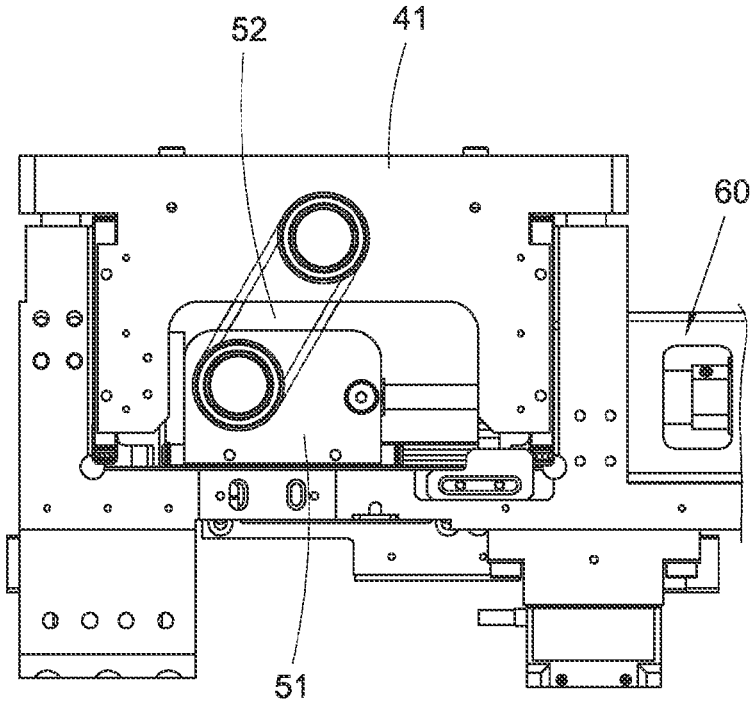
FIG. 6 is a front view of the preferred embodiment of the present invention, showing that the rocking arm is positioned in a descending position.
Figure 7:
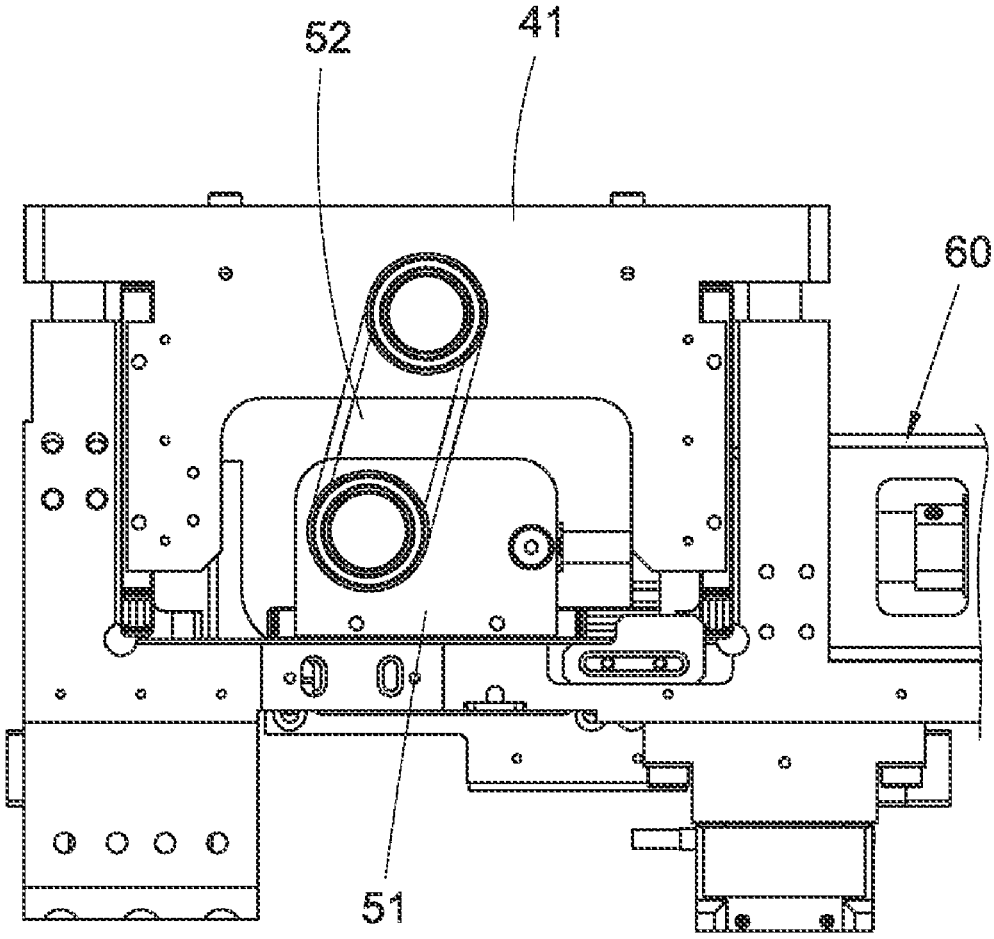
FIG. 7 is a front view of the preferred embodiment of the present invention, showing that the rocking arm is positioned between the ascending position and descending position.

Please refer to FIGS. 1 to 7. According to a preferred embodiment, the lifting mechanism 10 with self-locking function of the present invention includes a bed 20, a guide section 30, an ascending/descending seat 40, a rocking member 50, a drive section 60 and a prestressing section 70.

The bed 20 has a horizontal bed body 21 and two pier bodies 22 uprightly disposed on an upper face of the bed body 21 and spaced by a certain distance in parallel to each other.

The guide section 30 has two elongated Z-axis guide members 31 respectively disposed on opposite faces of the two pier bodies 22 with their lengths normal to the horizontal face. The guide section 30 further includes an elongated horizontal guide member 32 disposed on the upper face of the bed body 21 between the two pier bodies 22. To speak more specifically, the guide members 31, 32 can be embodied with cross roller ways, which pertain to prior art and will be only schematically described hereinafter. Each of the guide members 31, 32 has two parallel pairs of elongated guide rails 311, 321 including fixed guide rails 3111, 3211 and movable guide rails 3112, 3212. First side faces of the fixed guide rails 3111, 3211 are fixedly connected to corresponding sections of the bed 20. First side faces of the movable guide rails 3112, 3212 adjacently face second side faces of the fixed guide rails 3111, 3211. Two roller sets (not shown) are held between the adjacent side faces of the fixed guide rails 3111, 3211 and the movable guide rails 3112, 3212, whereby the movable guide rails 3112, 3212 can be slid along the fixed guide rails 3111, 3211 relative thereto.

The ascending/descending seat 40 has a board-like ascending/descending platform 41 and two coupling blocks 43 protruding from a bottom face of the ascending/descending platform 41 in parallel to each other. The coupling blocks 43 are spaced from each other by a certain distance. Two insertion channels 44 are respectively formed on backsides of the coupling blocks 43, whereby the Z-axis guide members 31 can be inserted in the insertion channels 44. The movable guide rails 3112 of the Z-axis guide members 31 are fixedly attached to sidewalls of the insertion channels 44. Accordingly, the Z-axis guide members 31 can guide the ascending/descending seat 40 to up and down reciprocally move in the direction of Z-axis.

The rocking member 50 has a slide seat 51. A notch is formed under a bottom side of the slide seat 51. The horizontal guide member 32 is inlaid in the notch. The movable guide rails 3212 of the horizontal guide member 32 are fixedly attached to a wall of the notch of the slide seat 51. Accordingly, the horizontal guide member 32 can guide the slide seat 51 to reciprocally horizontally move. The rocking member 50 further has a rocking arm 52 with a certain length. Two axial ends of the rocking arm 52 are respectively pivotally connected to the ascending/descending platform 41 and the slide seat 51 via pivot shafts 53. When the slide seat 51 is horizontally moved, the rocking arm 52 is up and down moved between an ascending position and a descending position. When positioned in the ascending position, the length of the rocking arm 52 is parallel to Z-axis, while when positioned in the descending position, the length of the rocking arm 52 and the Z-axis contain a certain angle.

The drive section 60 is fixedly disposed on the bed body 21. A power output shaft 61 of the drive section 60 is connected with the slide seat 51 for driving the slide seat 51 to horizontally move so as to drive the rocking arm 52 to move between the ascending position and descending position.

The prestressing section 70 includes several tightening members 71 each having a rear end. Preferably, the tightening members 71 are bolts.

The tightening members 71 are screwed through the ascending/descending seat 40 and the slide seat 51 with their rear ends in abutment with the backsides of the movable guide rails 3112, 3212. The tightening members 71 serve to press the movable guide rails 3112, 3212 toward the adjacent fixed guide rails 3111, 3211 so as to change the gaps therebetween. Accordingly, the sliding friction of the cross roller ways can be adjusted.

In use of the lifting mechanism 10 with self-locking function of the present invention, the drive section 60 provides power to move the rocking arm 52 to the ascending position. At this time, the ascending/descending platform 41 is lifted to an uppermost position where the rocking arm 52 is normal to the horizontal face and is able to apply an optimal supporting force to the ascending/descending platform 41. Even if power-cut takes place suddenly, the lifting mechanism 10 can still support the load. In the case that it is necessary to lift the ascending/descending platform 41 to a certain position below the uppermost position and locate the ascending/descending platform 41 in this position, the prestressing section 70 can provide sufficient frictional force for the rocking member 50 to support the ascending/descending platform 41 and securely keep the ascending/descending platform 41 in the position.

According to the above arrangement, the lifting mechanism 10 with self-locking function of the present invention has the following advantages:

1. The lifting mechanism 10 is applicable to a vacuumed operation environment such as a clean room to provide secure lifting and locating effect.
2. The lifting mechanism 10 has mechanical self-locking function and is free from the affection of power-cut or emergency stop. Accordingly, the lifting mechanism 10 can be conveniently used and self-locked at any height to ensure safety.
3. In the case that the load borne by the ascending/descending platform 41 changes, by means of the prestressing section 70, the sliding friction can be adjusted in accordance with actual requirements.
4. When a power-cut takes place or when the lifting mechanism 10 is self-locked, in the case that the lifting mechanism 10 encounters vibration or the vertical loadability is changed, the lifting mechanism 10 will remain self-locked to prevent the ascending/descending platform 41 from sliding down.

The above embodiment is only used to illustrate the present invention, not intended to limit the scope thereof. Many modifications of the above embodiment can be made without departing from the spirit of the present invention.

What is claimed is:

1. A lifting mechanism with self-locking function, comprising:

a bed;

a guide section for linear reciprocal motion;

an ascending/descending seat mounted on and guided by the guide section to up and down reciprocally move in the direction of Z-axis;

a rocking member with a predetermined length, a first end of the rocking member being pivotally connected to the ascending/descending seat;

a drive section having a power output terminal connected to a second end of the rocking member for driving the rocking member to pivotally move between an ascending position and a descending position, when positioned in the ascending position, the length of the rocking member being parallel to Z-axis, while when positioned in the descending position, the length of the rocking member and the Z-axis containing a predetermined angle; and a prestressing section for changing sliding friction of the guide section, wherein the guide section includes two elongated Z-axis guide members disposed on the bed and spaced in parallel to each other, the ascending/descending seat being bridged between the Z-axis guide members, the guide section further including an elongated horizontal guide member horizontally disposed on the bed between bottoms of the Z-axis guide members;

wherein the guide members are cross roller ways, each of the guide members having two parallel pairs of elongated guide rails, a first guide rail of each pair of guide rails having a side face adjacent to a side face of a second guide rail of the pair of guide rails, two roller sets being held between the adjacent side faces of the first and second guide rails of the two pairs of guide rails, whereby the first and second guide rails can be slid relative to each other.

2. The lifting mechanism with self-locking function as claimed in claim 1, wherein the prestressing section includes at least one tightening member disposed on the ascending/descending seat, one end of the tightening member abutting against a backside of the first guide rail of the pair of guide rails of the Z-axis guide member, whereby the tightening member can press the first guide rail toward the second guide rail so as to change a gap between the adjacent side faces of the first and second guide rails.

3. The lifting mechanism with self-locking function as claimed in claim 1, wherein the rocking member has a slide seat horizontally movably mounted on the horizontal guide member and connected with the power output terminal of the drive section, the rocking member further having an elongated rocking arm, one end of the rocking arm being pivotally connected with the ascending/descending seat, while the other end of the rocking arm being pivotally connected with the slide seat.

4. The lifting mechanism with self-locking function as claimed in claim 3, wherein the prestressing section includes at least one tightening member disposed on the slide seat, one end of the tightening member abutting against a backside of the first guide rail of the pair of guide rails of the horizontal guide member, whereby the tightening member can press the first guide rail toward the second guide rail so as to change a gap between the adjacent side faces of the first and second guide rails.

* * * * *